US010357142B1

(12) United States Patent
Simmons et al.

(10) Patent No.: US 10,357,142 B1
(45) Date of Patent: Jul. 23, 2019

(54) MISTY MAT SYSTEM

(76) Inventors: Dawn M. Simmons, Dunedin, FL (US); John J. Simmons, Dunedin, FL (US)

( * ) Notice: Subject to any disclaimer, the term of this patent is extended or adjusted under 35 U.S.C. 154(b) by 575 days.

(21) Appl. No.: 13/065,156

(22) Filed: Mar. 15, 2011

(51) Int. Cl.
*A47L 13/30* (2006.01)
*A47L 23/26* (2006.01)

(52) U.S. Cl.
CPC ..... *A47L 23/26* (2013.01)

(58) Field of Classification Search
USPC ..... 401/263, 137, 195, 261; 4/581–583; 239/273, 275, 289, 332, 565
See application file for complete search history.

(56) References Cited

U.S. PATENT DOCUMENTS

| | | | | |
|---|---|---|---|---|
| 2,573,008 | A * | 10/1951 | Gorden | 134/111 |
| 4,620,529 | A * | 11/1986 | Kurosawa | 601/157 |
| 4,765,542 | A * | 8/1988 | Carlson | 239/289 |
| 4,846,525 | A * | 7/1989 | Manning | 297/180.15 |
| 5,672,123 | A * | 9/1997 | Rudell et al. | 473/414 |
| 7,484,671 | B2 * | 2/2009 | Wigglesworth et al. | 239/20 |

* cited by examiner

*Primary Examiner* — David Walczak

(57) ABSTRACT

A pump is positioned on the upper surface of the mat adjacent to one edge. A spray nozzle on the upper surface of the mat is positioned to dispense a spray upwardly. Tubing has an input end coupled to the pump. The tubing has an output end coupled to the spray nozzle. An actuator pedal is coupled to the pump. In this manner when the pedal is depressed, the pump will move cleaning/disinfecting fluid from the pump and then through the tubing and then through the spray nozzle. Further in this manner a misty layer of cleaning/disinfecting fluid will be gently wafted onto the upper surface of the mat.

1 Claim, 3 Drawing Sheets

FIG. 1
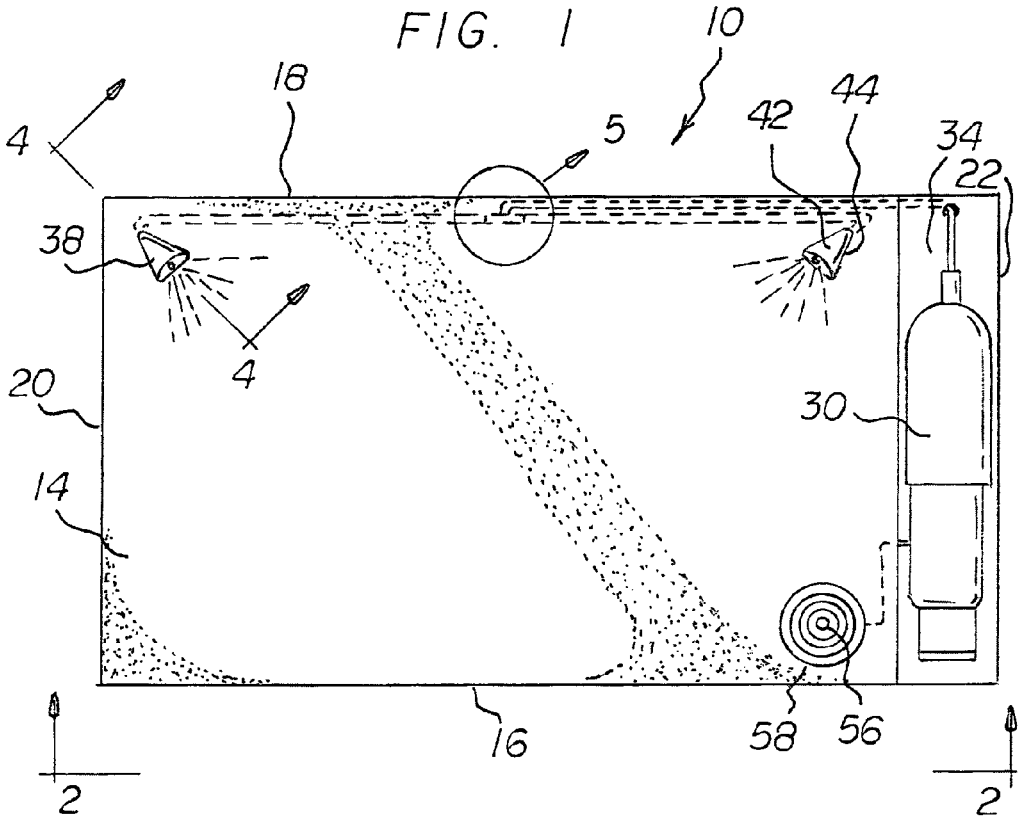
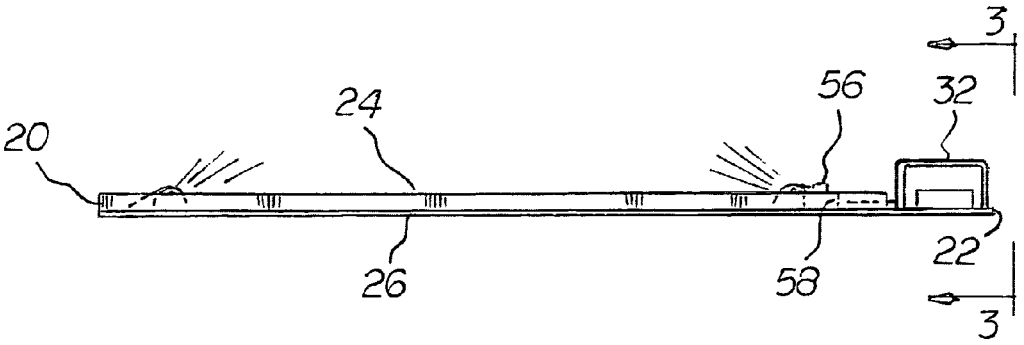
FIG. 2

FIG. 3
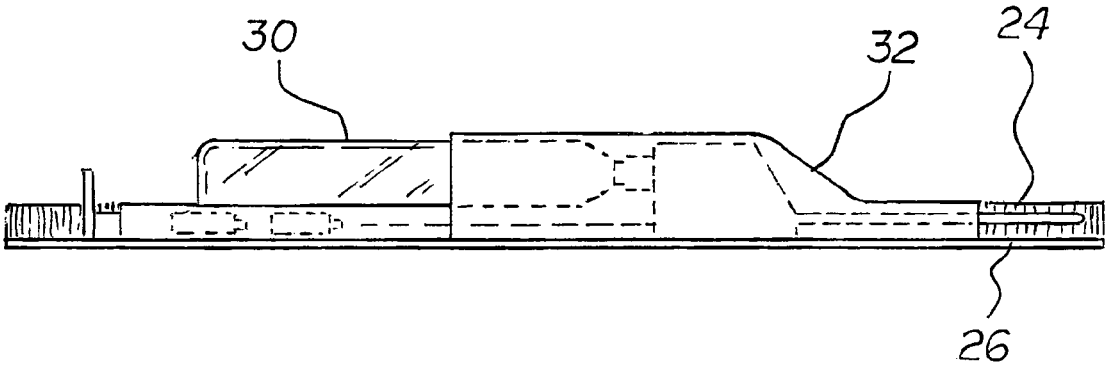
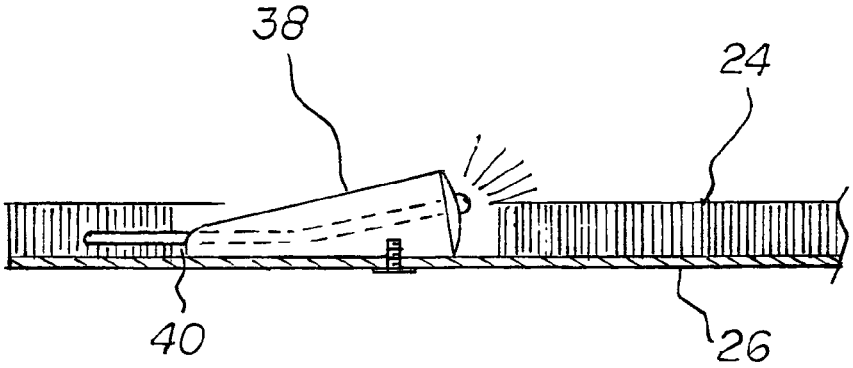
FIG. 4

FIG. 5
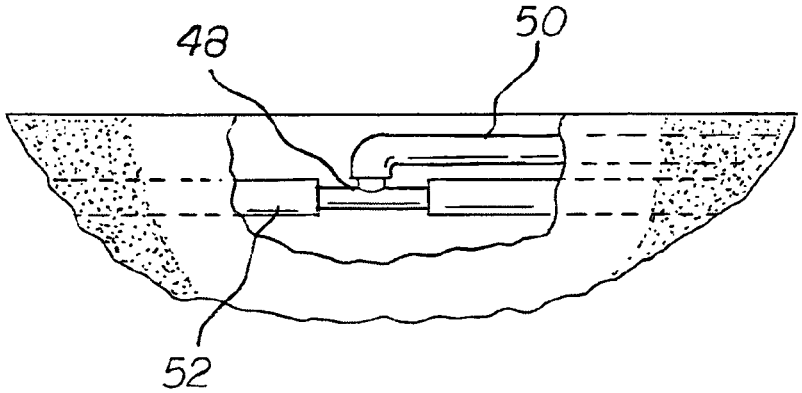
FIG. 7
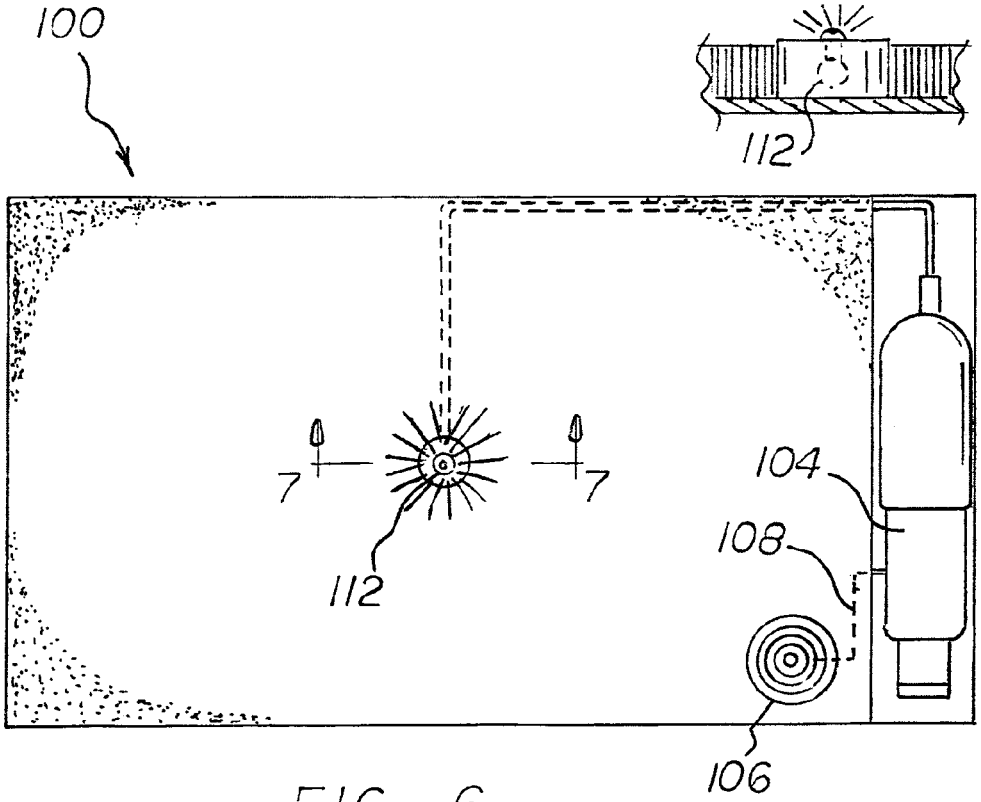
FIG. 6

MISTY MAT SYSTEM

BACKGROUND OF THE INVENTION

Field of the Invention

The present invention relates to a misty mat system and more particularly pertains to spraying a thin layer of a cleaning fluid onto a mat thereby enhancing the cleaning/disinfecting action to shoe soles when wiping one's feet, the spraying and the cleaning/disinfecting being done in a safe, sanitary, efficient and economical manner.

SUMMARY OF THE INVENTION

In view of the disadvantages inherent in the known types of cleaning systems of known designs and configurations now present in the prior art, the present invention provides an improved misty mat system. As such, the general purpose of the present invention, which will be described subsequently in greater detail, is to provide a new and improved misty mat system and method which has all the advantages of the prior art and none of the disadvantages.

To attain this, the present invention essentially comprises a misty mat system. First provided is a mat. The mat is fabricated of a durable long-lasting fibrous material. The durable long-lasting fibrous material is chosen from the class of durable long-lasting fibrous material. The class of durable long-lasting fibrous material includes coir, palmyra fibers, stalks and nylon. The mat is in a rectangular configuration with a front edge. The mat has a parallel rear edge. The front and rear edges are separated by a depth. The mat had parallel first and second side edges. The side edges are separated by a width. The mat has an upper surface. The mat has a lower surface. The lower surface is separated by a common mat thickness over the majority of the upper surface.

A battery powered electrical pump is provided. The pump is positioned on the upper surface of the mat adjacent to the first side edge. The pump contains a quantity of cleaning/disinfecting fluid. The cleaning/disinfecting fluid is adapted to be dispensed. A low profile housing is provided. The housing covers the pump. The upper surface of the mat has a rectangular recess. The rectangular recess extends from the first side edge. The rectangular recess further extends between the front and rear edges. The rectangular recess receives and supports the pump and the housing.

Provided next is a first spray nozzle. The upper surface of the mat has a first triangular recess. The first triangular recess is provided mat adjacent to the first side edge and the rear edge receiving and supporting the first spray nozzle. The first spray nozzle is positioned to dispense a spray upwardly at an angle of 30 degrees, plus or minus 10 percent, generally toward the front edge and the second side edge. A second spray nozzle is provided. The upper surface of the mat has a second triangular recess. The second spray nozzle is provided adjacent to the second side edge and the rear edge receiving and supporting the second spray nozzle. The second spray nozzle is positioned to dispense a spray upwardly at an angle of 30 degrees, plus or minus 10 percent, generally toward the front edge and the first side edge.

Further provided is a tube assembly. The tube assembly includes a primary tube. The tube assembly includes a secondary tube. The primary tube has an input end. The input end of the primary tube is coupled to the pump. The primary tube has an output end. The output end of primary tube is provided adjacent to the rear edge intermediate the first and second side edges. The secondary tube has opposed ends. The opposed ends are coupled to the first and second spray nozzles respectively. The secondary tube has a center equally spaced from the first and second spray nozzles. The center of the secondary tube is coupled to the output end of the primary tube.

Provided last is a circular actuator pedal. The upper surface of the mat has a circular recess. The circular recess is provided adjacent to the second side edge and the front edge receiving and supporting the actuator pedal. The actuator pedal is electrically coupled to the pump. In this manner when the pedal is depressed, the pump will be activated to move cleaning/disinfecting fluid from the pump and then through the primary and secondary tubes and then through the spray nozzles. Further in this manner a misty layer of cleaning/disinfecting fluid is gently wafted onto the upper surface of the mat for the cleaning/disinfecting action to shoe soles when wiping one's feet.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved misty mat system which has all of the advantages of the prior art cleaning systems of known designs and configurations and none of the disadvantages.

It is another object of the present invention to provide a new and improved misty mat system which may be easily and efficiently manufactured and marketed.

It is further object of the present invention to provide a new and improved misty mat system which is of durable and reliable constructions.

An even further object of the present invention is to provide a new and improved misty mat system which is susceptible of a low cost of manufacture with regard to both materials and labor, and which accordingly is then susceptible of low prices of sale to the consuming public, thereby making such misty mat system economically available to the buying public.

Even still another object of the present invention is to provide a misty mat system for spraying a thin layer of a cleaning fluid onto a mat thereby enhancing the cleaning/disinfecting action to shoe soles when wiping one's feet, the spraying and the cleaning/disinfecting being done in a safe, sanitary, efficient and economical manner.

Lastly, it is an object of the present invention to provide a new and improved misty mat system. A pump is positioned on the upper surface of the mat adjacent to one edge. A spray nozzle on the upper surface of the mat is positioned to dispense a spray upwardly. Tubing has an input end coupled to the pump. The tubing has an output end coupled to the spray nozzle. An actuator pedal is coupled to the pump. In this manner when the pedal is depressed, the pump will move cleaning/disinfecting fluid from the pump and then through the tubing and then through the spray nozzle. Further in this manner a misty layer of cleaning/disinfecting fluid will be gently wafted onto the upper surface of the mat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a plan view of a misty mat system constructed in accordance with the principles of the present invention.

FIG. 2 is a front elevational view taken along line 2-2 of FIG. 1.

FIG. 3 is a side elevational view taken along line 3-3 of FIG. 2.

FIG. 4 is a cross sectional view taken along line 4-4 of FIG. 1.

FIG. 5 is an enlarged plan view taken at circle 5 of FIG. 1 with parts broken away to illustrate certain internal constructions.

FIG. 6 is a plan view similar to FIG. 1 but illustrating an alternate embodiment of the invention.

FIG. 7 is a cross sectional view taken along line 7-7 of FIG. 6.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved misty mat system embodying the principles and concepts of the present invention and generally designated by the reference numeral 10 will be described.

The present invention, the misty mat system 10 is comprised of a plurality of components. Such components in their broadest context include a mat, a pump, a spray nozzle, tubing and an actuator pedal. Such components are individually configured and correlated with respect to each other so as to attain the desired objective.

First provided is a mat 14. The mat is fabricated of a durable long-lasting fibrous material. The durable long-lasting fibrous material is chosen from the class of durable long-lasting fibrous material. The class of durable long-lasting fibrous material includes coir, palmyra fibers, stalks and nylon. The mat is in a rectangular configuration with a front edge 16. The mat has a parallel rear edge 18. The front and rear edges are separated by a depth. The mat had parallel first and second side edges 20, 22. The side edges are separated by a width. The mat has an upper surface 24. The mat has a lower surface 26. The lower surface is separated by a common mat thickness over the majority of the upper surface.

A battery powered electrical pump 30 is provided. The pump is positioned on the upper surface of the mat adjacent to the second side edge. The pump contains a quantity of cleaning/disinfecting fluid. The cleaning/disinfecting fluid is adapted to be dispensed. A low profile housing 32 is provided. The housing covers the pump. The upper surface of the mat has a rectangular recess 34. The rectangular recess extends from the second side edge. The rectangular recess further extends between the front and rear edges. The rectangular recess receives and supports the pump and the housing.

Provided next is a first spray nozzle 38. The upper surface of the mat has a first triangular recess 40. The first triangular recess is provided mat adjacent to the first side edge and the rear edge receiving and supporting the first spray nozzle. The first spray nozzle is positioned to dispense a spray upwardly at an angle of 30 degrees, plus or minus 10 percent, generally toward the front edge and the second side edge. A second spray nozzle 42 is provided. The upper surface of the mat has a second triangular recess 44. The second spray nozzle is provided adjacent to the second side edge and the rear edge receiving and supporting the second spray nozzle. The second spray nozzle is positioned to dispense a spray upwardly at an angle of 30 degrees, plus or minus 10 percent, generally toward the front edge and the first side edge.

Further provided is a tube assembly 48. The tube assembly includes a primary tube 50. The tube assembly includes a secondary tube 52. The primary tube has an input end. The input end of the primary tube is coupled to the pump. The primary tube has an output end. The output end of primary tube is provided adjacent to the rear edge intermediate the first and second side edges. The secondary tube has opposed ends. The opposed ends are coupled to the first and second spray nozzles respectively. The secondary tube has a center equally spaced from the first and second spray nozzles. The center of the secondary tube is coupled to the output end of the primary tube.

Provided last is a circular actuator pedal 56. The upper surface of the mat has a circular recess 58. The circular recess is provided adjacent to the second side edge and the front edge receiving and supporting the actuator pedal. The actuator pedal is electrically coupled to the pump. In this manner when the pedal is depressed, the pump will be activated to move cleaning/disinfecting fluid from the pump and then through the primary and secondary tubes and then through the spray nozzles. Further in this manner a misty layer of cleaning/disinfecting fluid is gently wafted onto the upper surface of the mat for the cleaning/disinfecting action to shoe soles when wiping one's feet.

In an alternate embodiment 100 of the present invention, the pump is a pneumatic pump 104. The pedal includes a squeeze ball 106. A pneumatic line 108 is provided. The pneumatic line couples the pump and the ball.

The spray nozzle includes a single spray nozzle 112. The single spray nozzle is in a central extent of the upper surface of the mat. In this manner a spray may be projected upwardly and outwardly in all directions.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A misty mat system for spraying a thin layer of a cleaning fluid onto a mat thereby enhancing the cleaning/disinfecting action to shoe soles when wiping one's feet, the spraying and the cleaning/disinfecting being done in a safe, sanitary, efficient and economical manner, the system comprising, in combination:

a mat (14) fabricated of a durable long-lasting fibrous material chosen from the class of durable long-lasting fibrous material including coir, palmyra fibers, stalks and nylon, the mat being in a rectangular configuration with a front edge (16) and a parallel rear edge (18) separated by a depth, the mat having parallel first and second side edges (20), (22) separated by a width, the mat having an upper surface (24) and a lower surface (26) separated by a common mat thickness over the majority of the upper surface;

a battery powered electrical pump (30) positioned on the upper surface of the mat adjacent to the second side edge, the pump containing a quantity of cleaning/disinfecting fluid adapted to be dispensed, a low profile housing (32) covering the pump, a rectangular recess (34) in the upper surface of the mat and extending from the second side edge and extending between the front and rear edges, the rectangular recess receiving and supporting the pump and the housing;

a first spray nozzle (38), a first triangular recess (40) on the upper surface of the mat adjacent to the first side edge and the rear edge receiving and supporting the first spray nozzle, the first spray nozzle positioned to dispense a spray upwardly at an angle of 30 degrees, plus or minus 10 percent, generally toward the front edge and the second side edge, a second spray nozzle (42), a second triangular recess (44) on the upper surface of the mat adjacent to the second side edge and the rear edge receiving and supporting the second spray nozzle, the second spray nozzle positioned to dispense a spray upwardly at an angle of 30 degrees, plus or minus 10 percent, generally toward the front edge and the first side edge;

a tube assembly (48) including a primary tube (50) and a secondary tube (52), the primary tube having an input end coupled to the pump and an output end adjacent to the rear edge intermediate the first and second side edges, the secondary tube having opposed ends coupled to the first and second spray nozzles respectively, the secondary tube having a center equally spaced from the first and second spray nozzles, the center being coupled to the output end of the primary tube; and a circular actuator pedal (56), a circular recess (58) on the upper surface of the mat adjacent to the second side edge and the front edge receiving and supporting the actuator pedal, the actuator pedal being electrically coupled to the pump whereby when the pedal is depressed, the pump will be activated to move cleaning/disinfecting fluid from the pump and then through the primary and secondary tubes and then through the spray nozzles to gently waft a misty layer of cleaning/disinfecting fluid onto the upper surface of the mat for the cleaning/disinfecting action to shoe soles when wiping one's feet.

* * * * *